United States Patent [19]

Burke

[11] 4,044,542

[45] Aug. 30, 1977

[54] WATCH MODULE CONSTRUCTION

[75] Inventor: Roger A. Burke, Laguna Beach, Calif.

[73] Assignee: Hughes Aircraft Company, Culver City, Calif.

[21] Appl. No.: 691,815

[22] Filed: June 1, 1976

[51] Int. Cl.[2] ..... G04C 3/00

[52] U.S. Cl. ..... 58/23 R; 58/50 R; 58/88 R; 58/53

[58] Field of Search ..... 58/23 R, 53, 88 R, 50 R 55, 58/56; 40/152, 156; 206/44.12, 45.14, 45.15; 248/114–116

[56] References Cited

U.S. PATENT DOCUMENTS

| | | | |
|---|---|---|---|
| 1,210,934 | 1/1917 | Hayes | 40/152 |
| 3,863,436 | 2/1975 | Schwarzschild et al. | 58/50 R |
| 3,959,964 | 6/1976 | Yamazaki | 58/55 X |
| 3,983,689 | 10/1976 | Burke et al. | 58/50 R |
| 3,996,735 | 12/1976 | Zurcher | 58/50 R |

*Primary Examiner*—Ulysses Weldon

*Attorney, Agent, or Firm*—Allen A. Dicke, Jr.; W. H. MacAllister

[57] ABSTRACT

Digital display is retained in upper spacer of watch module by means of screws and a spring having resiliently deflected fingers engaging the upper spacer. Resilient deflection at both the screw attached end and the spring finger end resiliently restrains the display and ensures contact of the display with an elastomeric type connector.

4 Claims, 6 Drawing Figures

Fig. 1.
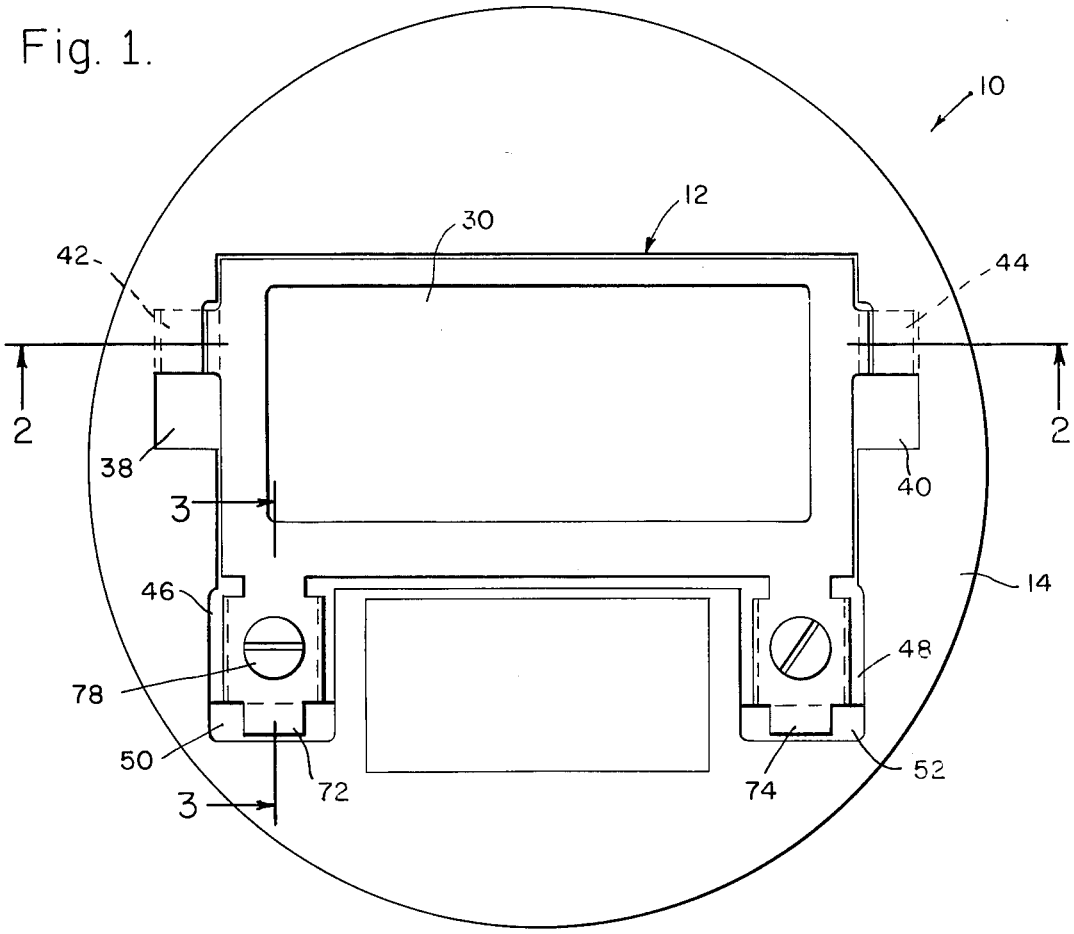
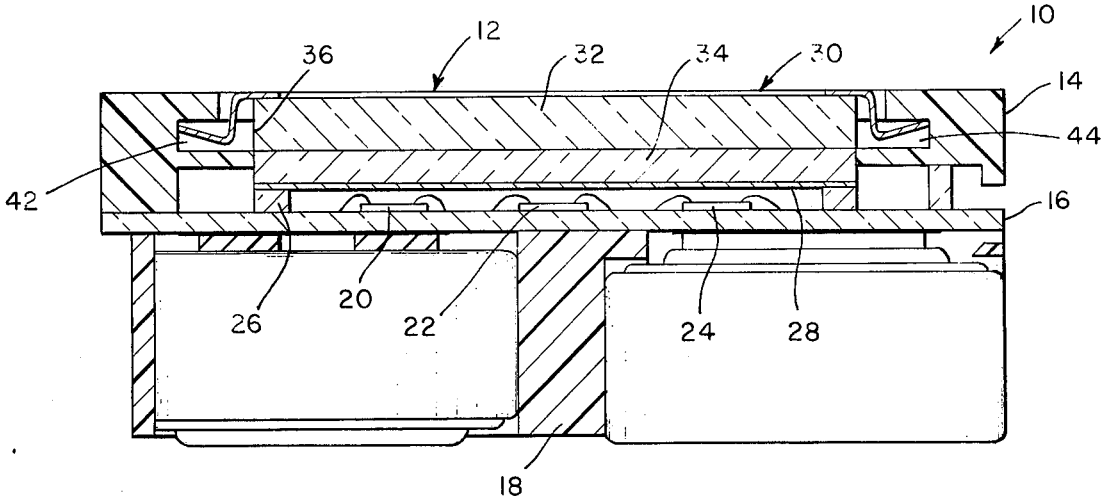
Fig. 2.

Fig. 4.
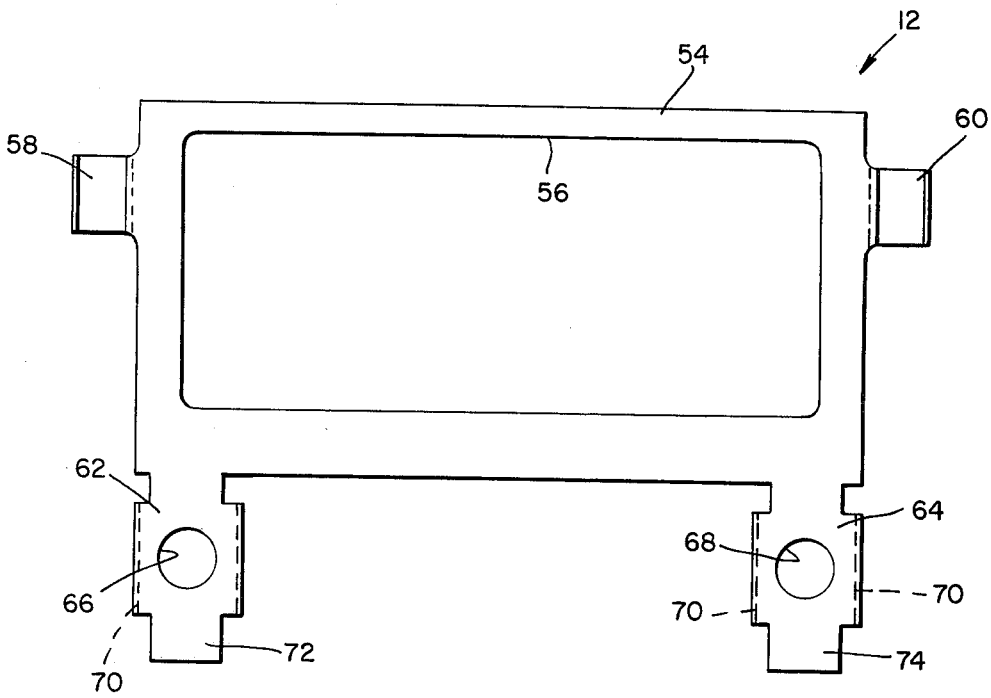
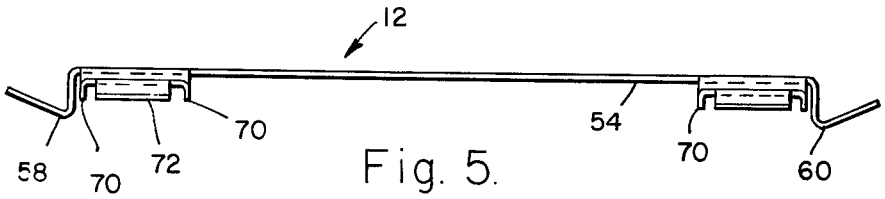
Fig. 5.
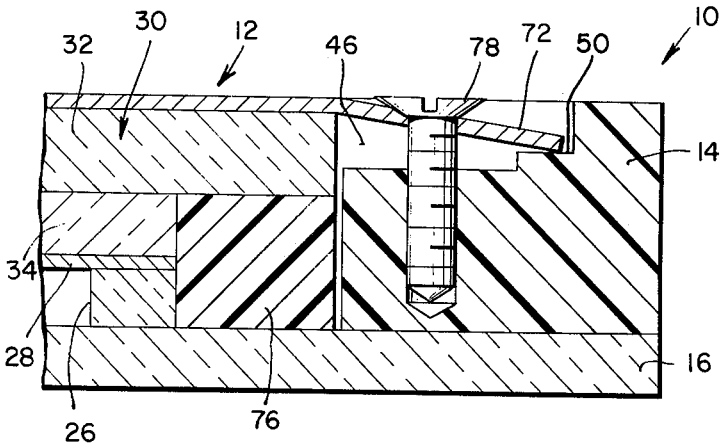
Fig. 3.
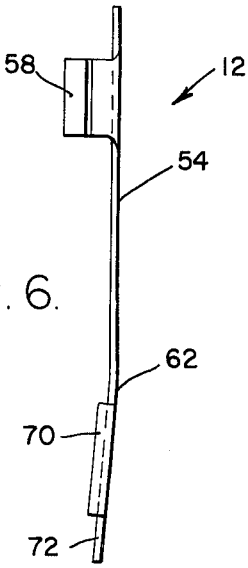
Fig. 6.

WATCH MODULE CONSTRUCTION

BACKGROUND OF THE INVENTION

This invention is directed to the structure of a digital watch module, and particularly the means for restraining the digital display device in the top spacer of the module.

Particularly in digital watches having liquid crystal displays it is helpful to provide for ready removal and replacement of the displays. This is because in the present state of the art, the liquid crystal displays do not have as long as a life as the light emitting diode type of digital display. Thus, it is more likely that the liquid crystal display will need to be replaced before the end of the lifetime of the remaining electronic and mechanical parts.

In order to aid in the ready exchange of liquid crystal displays, it is known that the pocket in which the display is received is open to the top of the top spacer so that it may be removed without disturbing the remainder of the module. In order to restrain the liquid crystal display in place, the prior art applies a restraining frame which is held in place by four or more screws. In assembling the watch module with that system the liquid crystal display device must be located in exact position, retained in place and then the frame positioned and restrained in place and finally the screws inserted to complete the assembly. Much holding is necessary and many parts must be handled. It is more convenient to be able to employ a resilient structure so that adjustment of the liquid crystal device can be achieved until the final holding screws are installed.

SUMMARY OF THE INVENTION

In order to aid in the understanding of this invention it can be stated in essentially summary form that it is directed to a digital watch module wherein the display device is resiliently restrained in place by means of a spring structure which resiliently engages in the top spacer block by means of a resiliently deflected spring finger and is retained by means of a positive mechanical attachment device.

It is thus an object of this invention to provide a digital watch module with an improved digital display device mounting structure for proper restraint and mounting of the display device in the top spacer of the digital watch module. It is another object of this invention to provide a mounting structure particularly useful for the mounting of liquid crystal display devices, to make it convenient to remove and replace such display devices. It is another object to provide a digital watch module in which a spring frame resiliently engages both the top spacer and the liquid crystal display to resiliently retain the liquid crystal display in place, and wherein the electrical connection between the liquid crystal display and the watch electronics is through an elastomeric type connector to which forces are applied by means of the resilient spring frame. It is a further object to provide a spring frame for restraining a display device in a watch module which provides easy assembly and continuing resiliency of mounting of the display device.

Other objects and advantages of this invention will become apparent from the study of the following portion of the specification, the claims and the attached drawings.

BRIEF DESCRIPTION OF THE DRAWINGS

FIG. 1 has a top plan view of a digital watch module employing the display retention structure of this invention.

FIG. 2 is a section taken generaly along line 2—2, FIG. 1.

FIG. 3 is an enlarged section, with parts broken away, taken generally along line 3—3 of FIG. 1.

FIG. 4 is a top-plan view of the display device retaining spring in its undeflected position.

FIG. 5 is a front edge view of the structure of FIG. 4.

FIG. 6 is a left edge view of the structure of FIG. 4.

DESCRIPTION

FIGS. 1, 2 and 3 show digital watch module 10 which employs the display device restraining spring frame 12, which is also seen in FIGS. 4, 5 and 6. Module 10 includes top spacer 14, substrate 16 and bottom spacer 18 which are clamped together by any convenient attachment means, such as springs which clamp over the two spacers and hold them together. The bottom spacer is provided with openings for the batteries which are connected to the electronics by battery contacts on the bottom of substrate 16. The lower electrodes of the batteries, as seen in FIG. 2, are connected together through the watch case or through a bridging battery contact spring.

Substrate 16 is of insulator material, such as ceramic and carries printed circuitry thereon for various interconnections. Integrated circuit chip 20, 22 and 24 are mounted on the top of the substrate and are connected to the printed circuitry through appropriate bonded wires. The electronics is controlled by various switches, as is known in the art, see U.S. Pat. No. 3,838,568. Frame 26 is mounted on the top of the substrate and carries cover 28 which encloses the area in which the chips and their interconnections are located for the protection thereof. Liquid crystal display 30 is positioned on the top of cover 28. Liquid crystal display 30 is formed of upper and lower plates 32 and 34 which extend to be even with each other on three sides, the left, right and top edges of FIG. 1, while at the lower edge of FIG. 1, top cover 32 extends beyond lower cover 34 to define contact area on the bottom of upper plate 32, as seen in FIG. 3.

Pocket 36 is rectangularly formed through top spacer 14 to receive liquid crystal display 30. Spring finger openings 38 and 40 are formed down into the top spacer and spring finger recesses 42 and 44 adjoin them. Tang recesses 46 and 48 are formed along one edge of the pocket and the tank recesses have tang shoulders 50 and 52 at the back edge thereof, see FIGS. 1 and 3.

Spring frame 12 which is used for retaining liquid crystal display 30 in its installed position is separately shown in FIGS. 4, 5 and 6. It comprises generally rectangular frame 54 which has a gemera;; generally rectangular interior opening 56 through which the digital liquid crystal display can be viewed. Spring fingers 58 and 60 extend downwardly and outwardly with respect to the main plane of frame 54, as is seen in FIG. 5, and are located on the sides near the upper corners. In the unstressed position, the ends of the fingers extend at an upward angle. Tangs 62 and 64 are formed on the opposite ends of the lower edge of frame 54. They respectively contain screw holes 66 and 68 and have downwardly turned edges 70 to strengthen the tang at the screw holes. Tang ends 72 and 74 extend out beyond the screw hole. The tangs are bent slightly downward in the unstressed position, see FIG. 6.

FIGS. 1, 2 and 3 illustrate spring frame 12 installed to retain liquid crystal display 30 in position. In view of manufacturing tolerances, the liquid crystal display is slightly smaller than its pocket 36. First, elastomeric type connector 76 is inserted along the lower edge of the pocket and in the recess under the extending edge of upper plate 32, see FIG. 3.

Lateral shifting of the display with repect to the connectors sometimes necessary to make proper interconnection. The lower part of the elastomeric type connector rests upon metalized contact strips on the top of substrate 16, where they extend out from the area of the electronic enclosure. Liquid crystal display 30 is placed in its pocket, spring frame 12 is positioned with its spring fingers in the spring finger openings. Then the spring fingers 58 and 60 are bent downward and engaged in spring finger recesses 42 and 44, by thrusting the frame upward, as seen in FIG. 1. There is downward stress applied onto liquid crystal display 30, by the deflection of fingers 58 and 60, but the liquid crystal display 30 can still be shifted to its proper location. When in the proper location, the resilient deflection of spring fingers 58 and 60 holds liquid crystal display 30 in place.

Thereupon screws 78 are inserted through the screw holes 66 and 68 and into appropriate openings in top spacer 14. As the screws are tightened down, tangs 72 and 74 engage on the tang shoulders 50 and 52. The shoulders restrain the tang so that the screw pulls down the lower edge of the frame onto the top of the liquid crystal display 30. The resiliency of the frame between the tang shoulders and the liquid crystal display resiliently holds the liquid crystal display in place. It is important to note that the screws are on the side which has the elastomeric connector 76, so that the screw force, which is the major holding force, is applied to the elastomeric connector to maintain firm and reliable electrical connection. The elastomeric connector is a stack of alternate thin layers of conductive and nonconductive elastomer so that clamping force is necessary thereon for reliable electrical connection.

This invention having been described in its preferred embodiment, it is clear that it is susceptible to numerous modifications and embodiments within the ability of those skilled and the art and without the exercise of the inventive faculty. Accordingly, the scope of this invention is defined by the scope of the following claims.

What is claimed is:

1. A digital watch module comprising:

a top spacer having a pocket therein for receipt of a digital display device and electrical contacts in said pocket for making contact with a display device in said pocket, said pocket having a bottom to serve as a limiting position of a display device in said pocket;

a digital display device sized to fit within said pocket and being positioned within said pocket and resting on said bottom;

a spring frame engaging over said display device and engaging in said top spacer for resiliently restraining said display device and retaining it in said pocket, said spring frame having first and second spring fingers thereon respectively engaging in first and second spring-finger recesses in said top spacer, said spring fingers being resiliently deflected to urge said spring frame downwardly on the said display device, said spring frame further having first and second tangs thereon and a screw through each of said tangs and into said top spacer for retaining said spring frame with a respect to said top spacer.

2. The digital watch module of claim 1 wherein said tangs on said spring frame have tang ends thereon, said top spacer having shoulders positioned under said tang ends, said tang being unsupported under said screws through said tangs so that said screws urge said spring frame down against said display device.

3. The digital watch module of claim 2 wherein said display device is a liquid crystal display device and a resilient connector is positioned underneath one edge of said display device for a connection between said display device and connections to the watch electronics, said tangs being positioned along the edges said resilient spring frame over said resilient connector.

4. The digital watch module of claim 3 wherein said spring fingers are positioned on said spring frame adjacent corners away from said tangs.

* * * * *